US010791816B2

(12) United States Patent
Kumar

(10) Patent No.: US 10,791,816 B2
(45) Date of Patent: Oct. 6, 2020

(54) FLUID DISCHARGER AND APPLICATOR DEVICE

(71) Applicant: Selva Kumar, Houston, TX (US)

(72) Inventor: Selva Kumar, Houston, TX (US)

(73) Assignee: Selva Kumar, Houston, TX (US)

( * ) Notice: Subject to any disclaimer, the term of this patent is extended or adjusted under 35 U.S.C. 154(b) by 178 days.

(21) Appl. No.: 15/249,404

(22) Filed: Aug. 27, 2016

(65) Prior Publication Data

US 2017/0007001 A1 Jan. 12, 2017

Related U.S. Application Data

(63) Continuation-in-part of application No. 13/932,904, filed on Jul. 1, 2013, now Pat. No. 9,434,081.

(51) Int. Cl.

| | |
|---|---|
| ***A45D 34/04*** | (2006.01) |
| ***B26B 21/40*** | (2006.01) |
| ***B26B 21/44*** | (2006.01) |

(52) U.S. Cl.

CPC ..... *A45D 34/042* (2013.01); *B26B 21/4081* (2013.01); *B26B 21/446* (2013.01); *Y10T 29/49817* (2015.01)

(58) Field of Classification Search

CPC ..... A46B 11/0041

See application file for complete search history.

(56) References Cited

U.S. PATENT DOCUMENTS

| | | | | |
|---|---|---|---|---|
| 359,527 | A * | 3/1887 | Wirz | |
| 1,977,212 | A * | 10/1934 | Seyffer | A46B 11/0041 401/290 |
| 6,345,723 | B1 * | 2/2002 | Blake | A47G 23/0241 211/73 |
| 6,488,034 | B1 * | 12/2002 | Blazek | A45D 29/04 132/76.4 |
| 6,991,200 | B2 * | 1/2006 | Stillman | A47J 45/02 15/257.01 |
| 8,858,484 | B2 * | 10/2014 | Casey | A45D 34/00 604/3 |
| 9,867,973 | B2 * | 1/2018 | Chiang | A61M 35/006 |
| 2004/0068218 | A1 * | 4/2004 | Davis | A61M 35/006 604/2 |

* cited by examiner

*Primary Examiner* — Sarah B McPartlin

(57) ABSTRACT

A fluid discharger and applicator device for uniform distribution or application of the fluid for treating the skin or any surface is disclosed. The fluid discharger and applicator device comprises a handle, a dispenser connector and a dispenser member. The handle of the fluid discharger and applicator device is defined with a cavity to store a fluid. The handle is further defined with a dispenser end configured to dispense the fluid stored within the cavity of the handle. The dispenser connector of the fluid discharger and applicator device is removably fastened to the dispenser end of the handle. The dispenser connector is configured to transfer the fluid extruded from the cavity of the handle on the dispenser member, which is operably attached to the dispenser connector. The dispenser member of the fluid discharger and applicator device is configured to apply the fluid on skin of a user.

8 Claims, 10 Drawing Sheets

90

FLUID DISCHARGER AND APPLICATOR DEVICE

BACKGROUND OF THE INVENTION

A. Technical Field

The present invention generally relates to a hand-held fluid discharger and applicator device configured for discharging and applying a fluid, and more specifically relates to a device for discharging and applying a fluid to the skin, or in any surface for household use and so on.

B. Description of Related Art

Generally, as part of a wet shaving process or a skin caring and cosmetic process, a user applies a skin preparation or a fluid to their skin using a brush, or their hands prior to shaving their hair in the skin, or for treating their skin, or for treating any surfaces. The preparation or fluids may be soap, foam, gel, lotion, etc. For hygienic treatment, it is recommended to apply the fluid on the skin using a sponge rather than using their bare fingers. Further, holding the sponges using the bare-fingers for treatment is also unhygienic, as it will restrict the free airflow through the sponge. This action further obstructs effective penetration of fluid through the skin pores. In addition, these sponges get wet and becomes too hard to hold it through the bare fingers during the application over the skin.

The use of cosmetic wedges in bare hand to enable a person to dip and apply the fluid for treating their skin, or any surfaces is well-known in the art. As further known in the art, the shaving system comprises skin care facilities by using soft sponge like material or a lubricating strip coupled to the shaving cartridge for easy dip and application of shaving lotion, creams, moisturizer and other cosmetic thereof. However, this is a messy and lengthy process, which requires the use of multiple products/tools such as cosmetic wedges bare hand or shaving cartridge to enable a person to dip and apply the fluid for treating their skin, or any surfaces. Even though the present art eliminates the use of sponges, brushes, lubricating strip or the like during shaving process, but they lack in uniform discharge and application of the fluids to the user's skin or on any surfaces.

Therefore, there is a need for a device capable of uniformly discharging, distributing or applying the fluid for treating the skin or any other surfaces. There is also exists a need for a device comprising a handle for introduction and application of the fluid to the skin.

SUMMARY OF THE INVENTION

The present invention relates to a fluid discharger and applicator device for uniform distribution or application of the fluid for treating the skin or any surface. In an embodiment, the fluid discharger and applicator device comprises a handle, a dispenser connector and a dispenser member. In one embodiment, the handle of the fluid discharger and applicator device is defined with a cavity to store one or more fluids. The handle is further defined with a dispenser end configured to dispense the fluid stored within the cavity. In an embodiment, the dispenser connector of the fluid discharger and applicator device is removably fastened to the dispenser end of the handle. In one embodiment, the dispenser connector is configured to transfer the fluid extruded from the cavity of the handle on the dispenser member, which is operably attached to the dispenser connector. The dispenser member of the fluid discharger and applicator device is configured to apply the fluid on skin of a user.

In an embodiment, the handle is a flask, a cartridge, a tube, a box or a plate, which defines the cavity in it. In one embodiment, the fluid discharger and applicator device comprising the handle defined with the cavity is configured to refillable with the fluid. In an embodiment, the handle is openable and closeable type. The handle may be layered, where one layer of the handle is removably fastened to the other layer to enable opening and closing of the layers in the handle. In an embodiment, the handle and the dispenser member is disposable, or reused. The handle is retrofitted via the dispenser end to the dispenser connector integrated with the dispenser member. In one embodiment, the handle comprises at least one of a pliable plastic or a rubber material. In one embodiment, the handle is provided with a circular or an elliptical cross section. In another embodiment, the handle is provided with a grip, a grooved, a rough or an etched glass surface.

In one embodiment, the dispenser connector is removably fastened via a threaded connection, snapfit connection, or a friction type connection to the dispenser end of the handle. In an embodiment, the dispenser member is imbedded to a base of the dispenser connector. In one embodiment, the dispenser member comprises one of a sponge-like material, a hydrophilic foam pad, a latex-free sponge material or a rubber-like material. In an embodiment, the dispenser member comprises a cone-shaped structure made of soft rubber-like material. In one embodiment, the dispenser connector transfer the fluid through a plurality of holes in the cone-shaped structure to the user skin.

In one embodiment, the fluid comprises at least one of a liquid, a pre-shave lotion, a gel, a moisturizer, a skin cream and a paste. In an embodiment, the fluid discharger and applicator device further comprises a holder to hang the device in up-right position, where the fluid is prevented to further flow due to gravity during a standby mode.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that evolve within the meaning and range of equivalency of the claims are to be embraced within their scope.

Figure 1B:
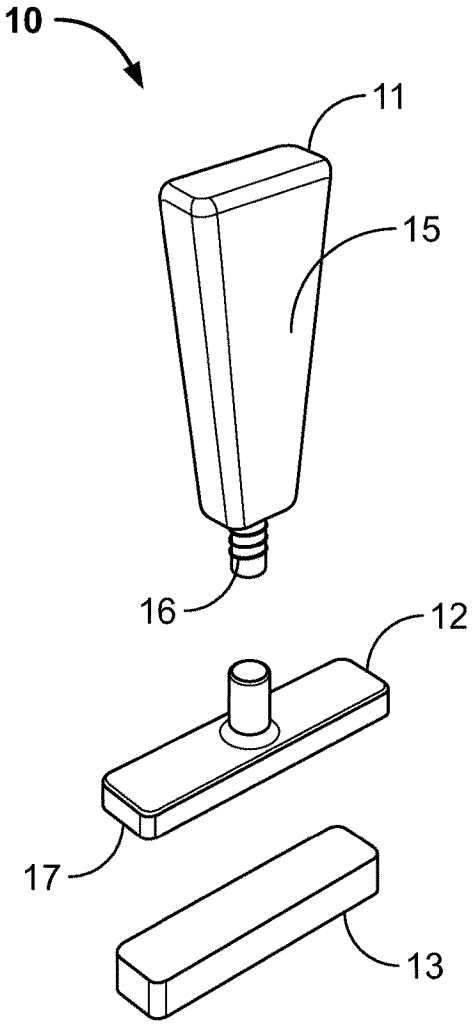
FIG. 1B shows an exploded view of the fluid discharger and applicator device with the flask handle.
Figure 1A:
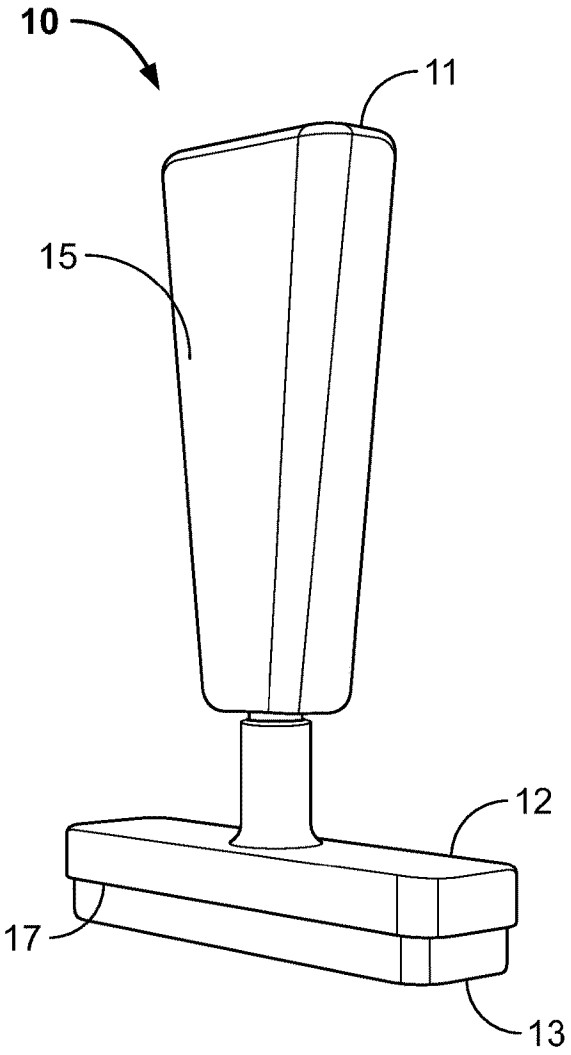
FIG. 1A shows a perspective view of the fluid discharger and applicator device with a flask handle according to an embodiment.

The present invention relates to a fluid discharger and applicator device 10 for uniform discharge, distribution or application of the fluid for treating the skin or any surface. Referring to FIG. 1A and FIG. 1B, the fluid discharger and applicator device 10 comprises a handle 11, a dispenser connector 12 and a dispenser member 13. In one embodiment, the handle 11 of the fluid discharger and applicator device 10 is defined with a cavity 15 to store one or more fluids. The handle 11 is further defined with a dispenser end 16 configured to dispense the fluid stored within the cavity 15. In an embodiment, the dispenser connector 12 of the fluid discharger and applicator device 10 is removably fastened to the dispenser end 16 of the handle 11. In one embodiment, the dispenser connector 12 is configured to transfer the fluid extruded from the cavity 15 of the handle 11 on the dispenser member 13, which is operably attached to the dispenser connector 12. The dispenser member 13 of the fluid discharger and applicator device 10 is configured to apply the fluid on the skin of a user.

In an embodiment, the handle 11 is a flask, a cartridge, a tube, a box or a plate, which defines the cavity 15 in it. In one embodiment, the fluid discharger and applicator device 10 comprising the handle 11 defined with the cavity 15 is refillable with the fluid. In an embodiment, the handle 11 is disposable, or reused. The handle 11 is retrofitted via the dispenser end 16 to the dispenser connector 12 integrated with the dispenser member 13. In one embodiment, the handle 11 comprises at least one of a pliable plastic or a rubber material.

In one embodiment, the dispenser connector 12 is removably fastened via a threaded connection, snapfit connection, or a friction type connection to the dispenser end of the handle 11. In an embodiment, the dispenser member 13 is imbedded to a base 17 of the dispenser connector 12. In one embodiment, the dispenser member 13 comprises one of a sponge-like material, a hydrophilic foam pad, a latex-free sponge material or a rubber-like material. In one embodiment, the fluid comprises at least one of a liquid, a pre-shave lotion, a gel, a moisturizer, a skin cream and a paste. In an embodiment, the dispenser member 13 is disposable, or reused.

Referring to FIG. 1A and FIG. 1B, shows a perspective and exploded view of the fluid discharger and applicator device 10 with flask handle 11 according to an embodiment. The fluid discharger and applicator device 10 comprises flask handle 11 with the cavity 15 and the dispenser end 16, attached to the dispenser connector 11 with the integrated dispenser member 13. In one embodiment, the dispenser end 16 of the flask handle 11 is attached to the dispenser connector 12 by threaded connection. The dispenser end 16 of the flask handle 11 is twisted into the dispenser connector 12.

In an embodiment, the user applies pressure on the flask handle 11 to extrude the required amount of fluids such as a pre-shave oil. In one embodiment, the user squeezes the flask handle 11 to extrude the required amount of fluids. In another embodiment, the user application of the pressure or squeeze on the flask handle 11 depends on the viscosity of the oil. In an embodiment, the fluid flows from the cavity 15 of the flask handle 11 through the dispenser connector 12 into the dispenser member 13. The user could apply fluid on the skin by placing the dispenser member 13 on the skin.

Figure 2B:
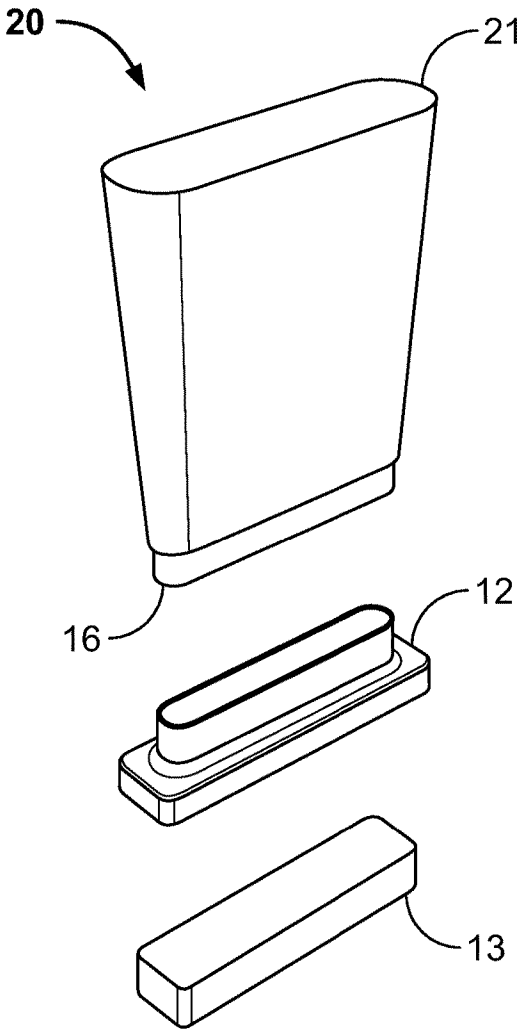
FIG. 2B shows an exploded view of the fluid discharger and applicator device with the cartridge handle.
Figure 2A:
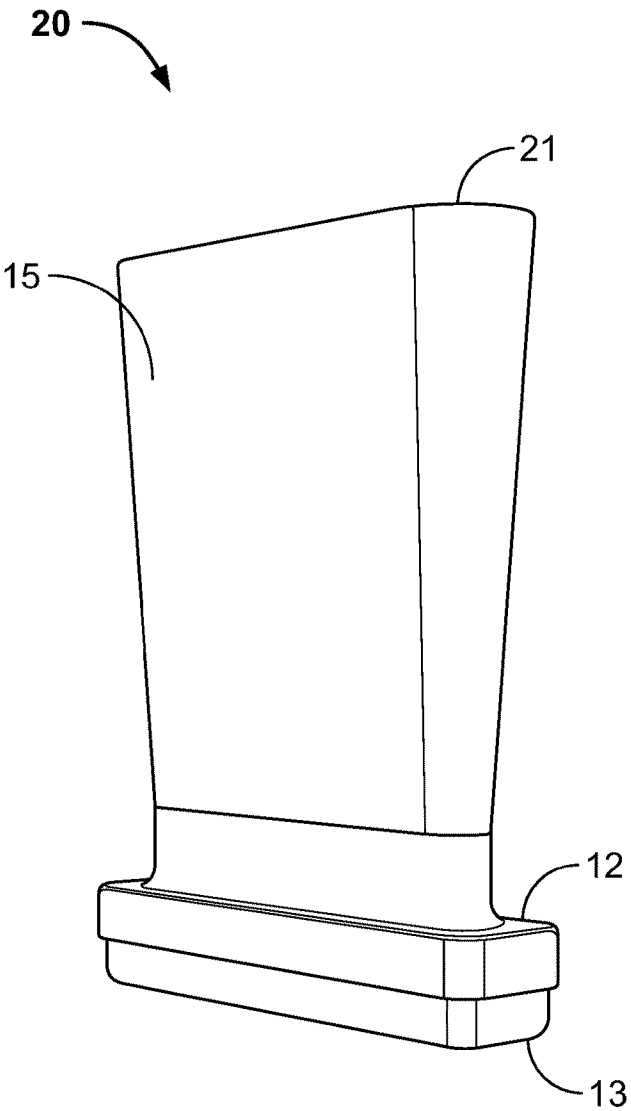
FIG. 2A shows a perspective view of the fluid discharger and applicator device with a cartridge handle according to another embodiment.

Referring to FIG. 2A and FIG. 2B, shows a perspective and exploded view of the fluid discharger and applicator device 20 with a cartridge handle 21 according to an embodiment. The fluid discharger and applicator device 20 comprises cartridge handle 21 with cavity 15 and dispenser end 16, attached to the dispenser connector 12 with the integrated dispenser member 13. In one embodiment, the dispenser end 16 of the cartridge handle 21 is attached to the dispenser connector 12 by snapfit or friction type connection. The dispenser end 16 of the cartridge handle 21 is right-sized to clamp into the dispenser connector 12.

In an embodiment, the user applies pressure on the cartridge handle 21 to extrude the required amount of fluids such as a pre-shave oil. In one embodiment, the user squeezes the cartridge handle 21 to extrude the required amount of fluids. In another embodiment, the user application of the pressure or squeeze on the cartridge handle 21 depends on the viscosity of the oil. In an embodiment, the fluid flows from the cavity 15 of the cartridge handle 21 through the dispenser connector 12 into the dispenser member 13. The user could apply fluid on the skin by placing the dispenser member 13 on the skin.

Figure 3B:
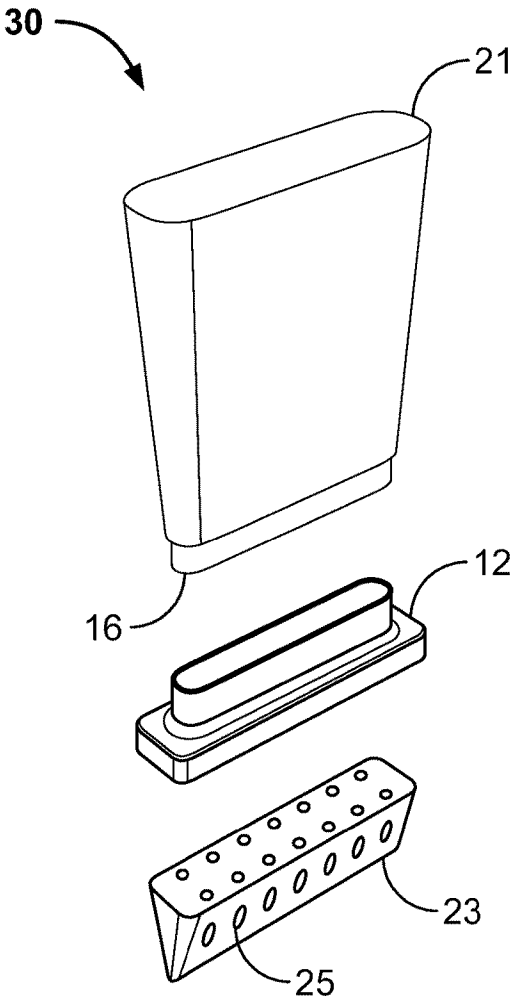
FIG. 3B shows an exploded view of the fluid discharger and applicator device with the cone-shaped dispenser member.
Figure 3A:
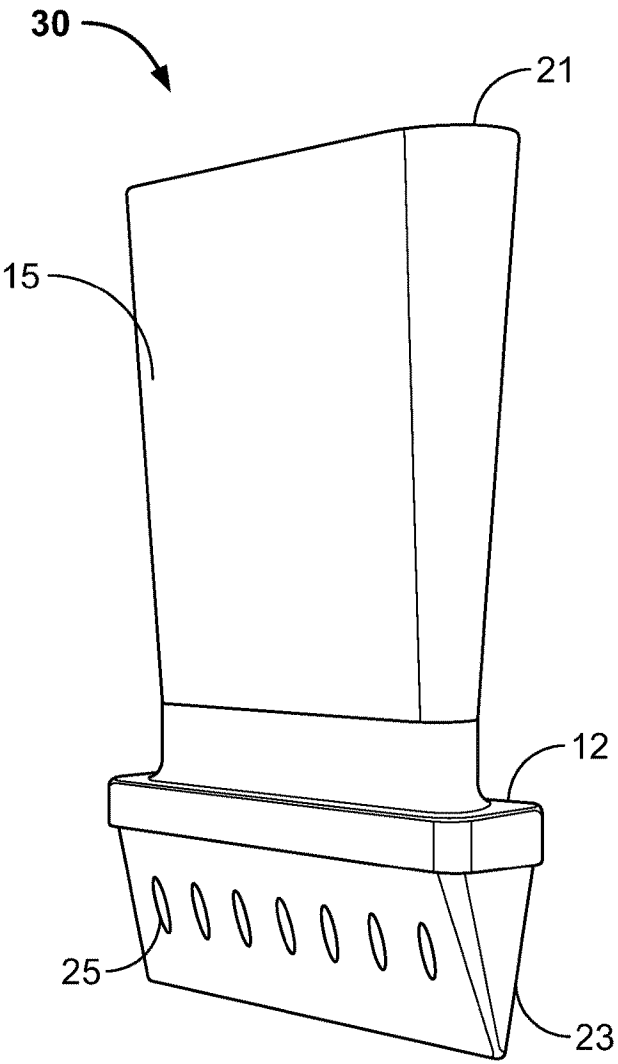
FIG. 3A shows a perspective view of the fluid discharger and applicator device with a cone-shaped dispenser member according to another embodiment.

Referring to FIG. 3A and FIG. 3B, shows a perspective and exploded view of the fluid discharger and applicator device 30 with a with a cone-shaped dispenser member 23 according to an embodiment. In an embodiment, the fluid discharger and applicator device 30 mentioned in FIGS. 3A and 3B is similar to the fluid discharger and applicator device 20 with the cartridge handle 21 referred in FIG. 2A and FIG. 2B, except the dispenser member 23. In an embodiment, the dispenser member 23 is a cone-shaped structure made of soft rubber-like material. In one embodiment, the dispenser member 23 is a spatula structure made of soft rubber-like material. In one embodiment, the fluid flows from the dispenser connector 12 through plurality of holes 25 inside the cone-shaped structure. The soft rubber material is used to bend while applying the fluid against the skin, and disperse the fluid flowing through the holes 25 on the skin.

Figure 4:
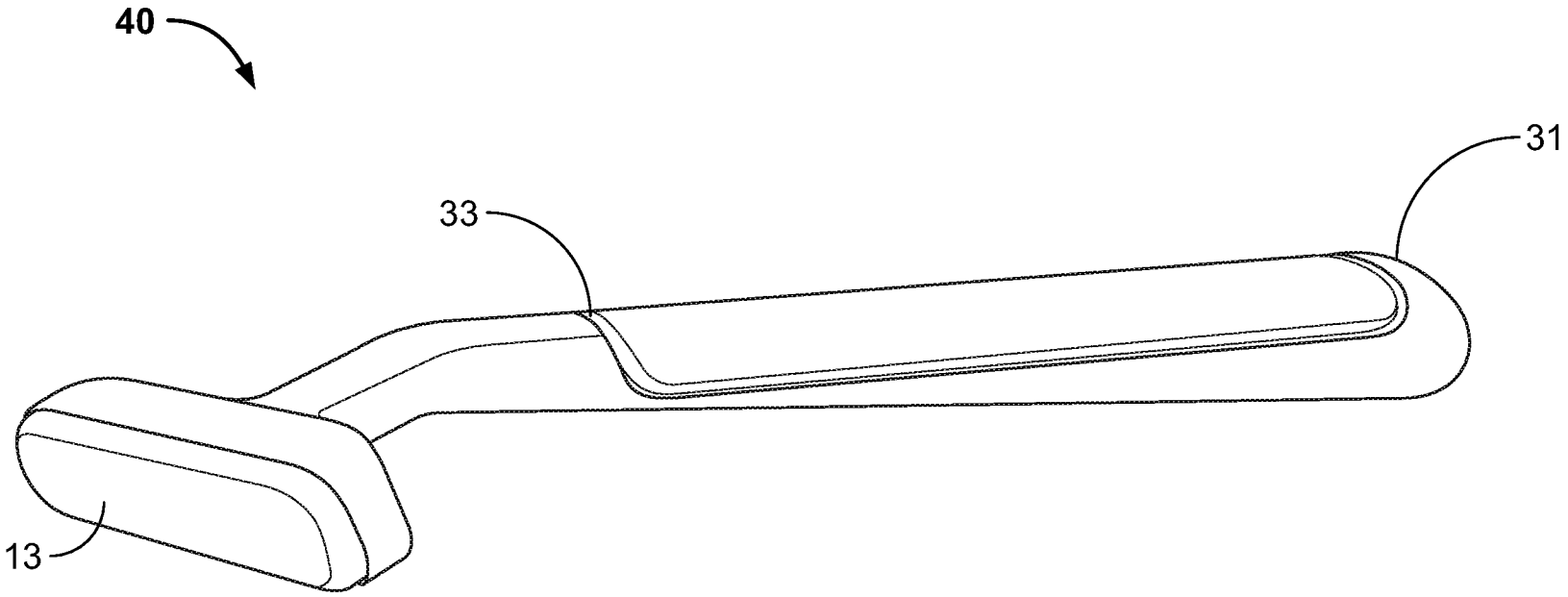
FIG. 4 shows a schematic view of the fluid discharger and applicator device with a tubular handle in elliptical cross section according to another embodiment.

FIG. 4 shows a schematic view of the fluid discharger and applicator device 40 with tubular handle 31 in elliptical cross section according to another embodiment. In one embodiment, the dispenser member 13 is fixed to the handle 31, where the surface of the handle 31 may have a characteristics angled cut 33 at an end for firm holding by the user. In one embodiment, the dispenser member 13 is a sponge head. The width of the dispenser member 13 ranges from about 20 mm to 40 mm, and the length of the handle 31 ranges from about 90 mm to 100 mm.

Figure 5:
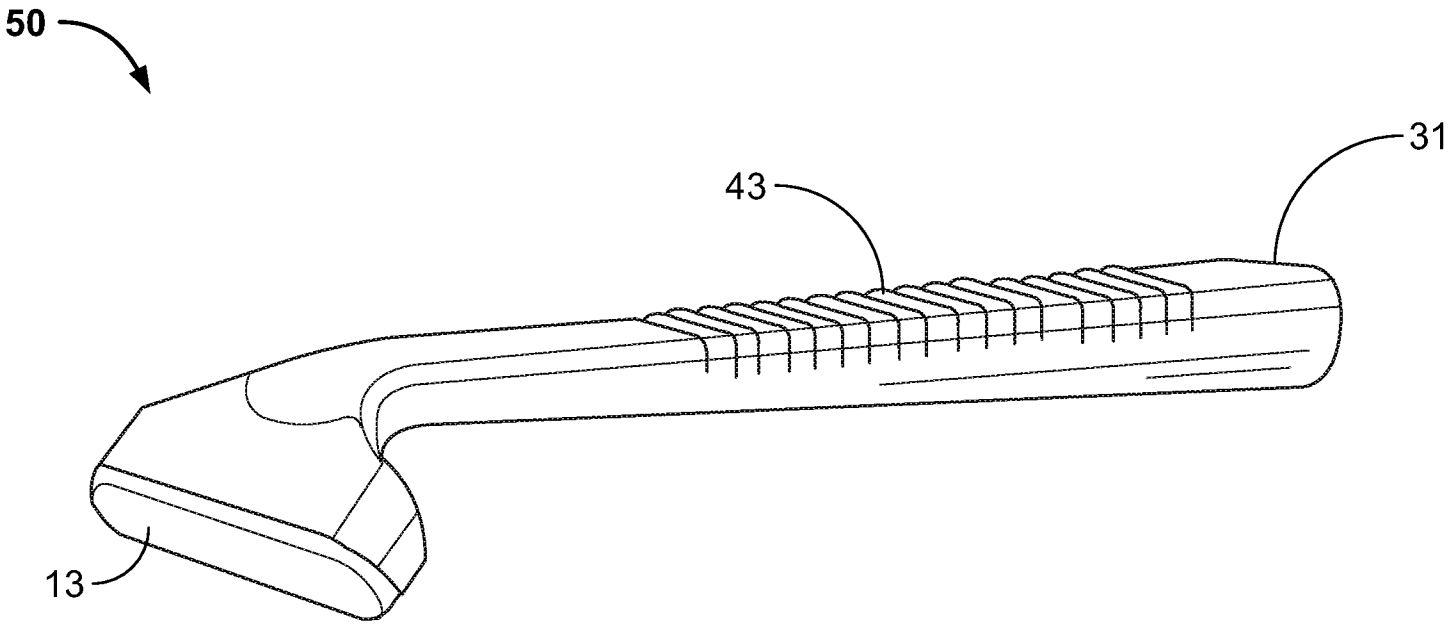
FIG. 5 shows a schematic view of the fluid discharger and applicator device with the tubular handle with a grip structure according to another embodiment.

FIG. 5 shows a schematic view of the fluid discharger and applicator device 50 with the tubular handle 31 with a grip structure 43 according to another embodiment. In one embodiment, the dispenser member 13 is fixed to the handle 31, where the surface of the handle 31 may have a non-smooth surface for firm holding by the user. In another embodiment, the dispenser member is fixed to the handle 31, where the surface of the handle may have a non-smooth bold and solid lined surface for firm holding by the user. In one embodiment, the dispenser member 13 is a sponge head. The width of the dispenser member 13 ranges from about 20 mm to 40 mm, and the length of the handle 31 ranges from about 90 mm to 100 mm.

Figure 6:
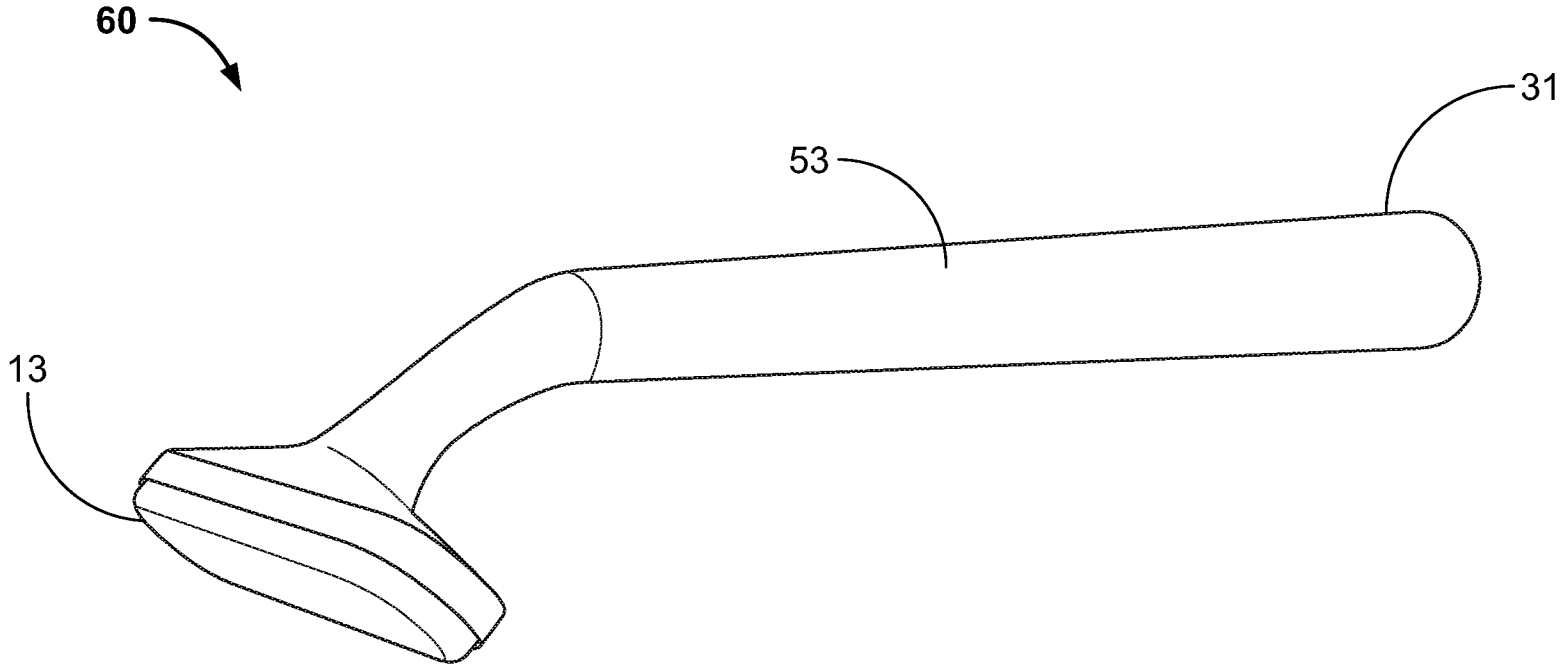
FIG. 6 shows a schematic view of the fluid discharger and applicator device with a tubular handle in circular cross section according to another embodiment.

FIG. 6 shows a schematic view of the fluid discharger and applicator device 60 with a tubular handle 31 in circular cross section 53 according to another embodiment. In one embodiment, the dispenser member 13 is fixed to the handle 31, where the surface of the handle 31 may have a smooth surface for a smooth feel by the user. In one embodiment, the dispenser member 13 is a sponge head. The width of the dispenser member 13 ranges from about 20 mm to 40 mm, and the length of the handle 31 ranges from about 90 mm to 100 mm.

Figure 7:
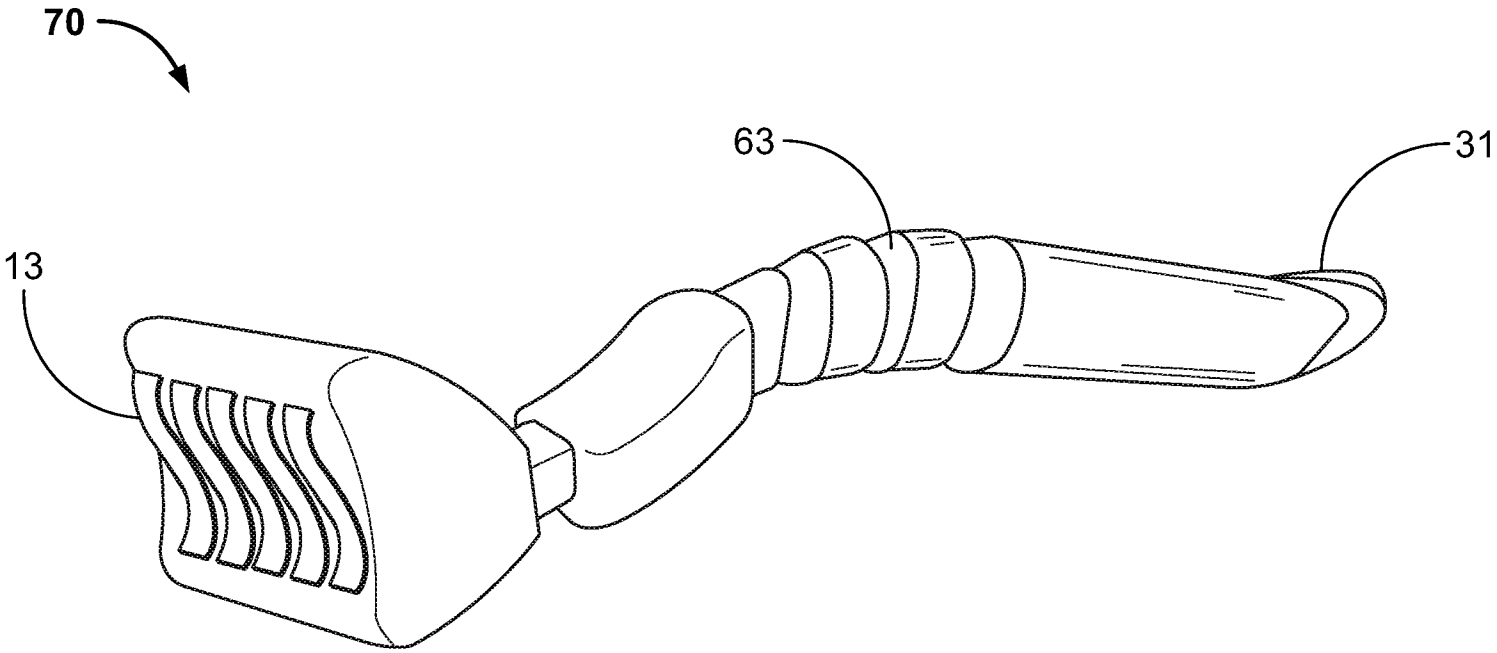
FIG. 7 shows a schematic view of the fluid discharger and applicator device with the tubular handle with a groove structure according to another embodiment.
Figure 8A:
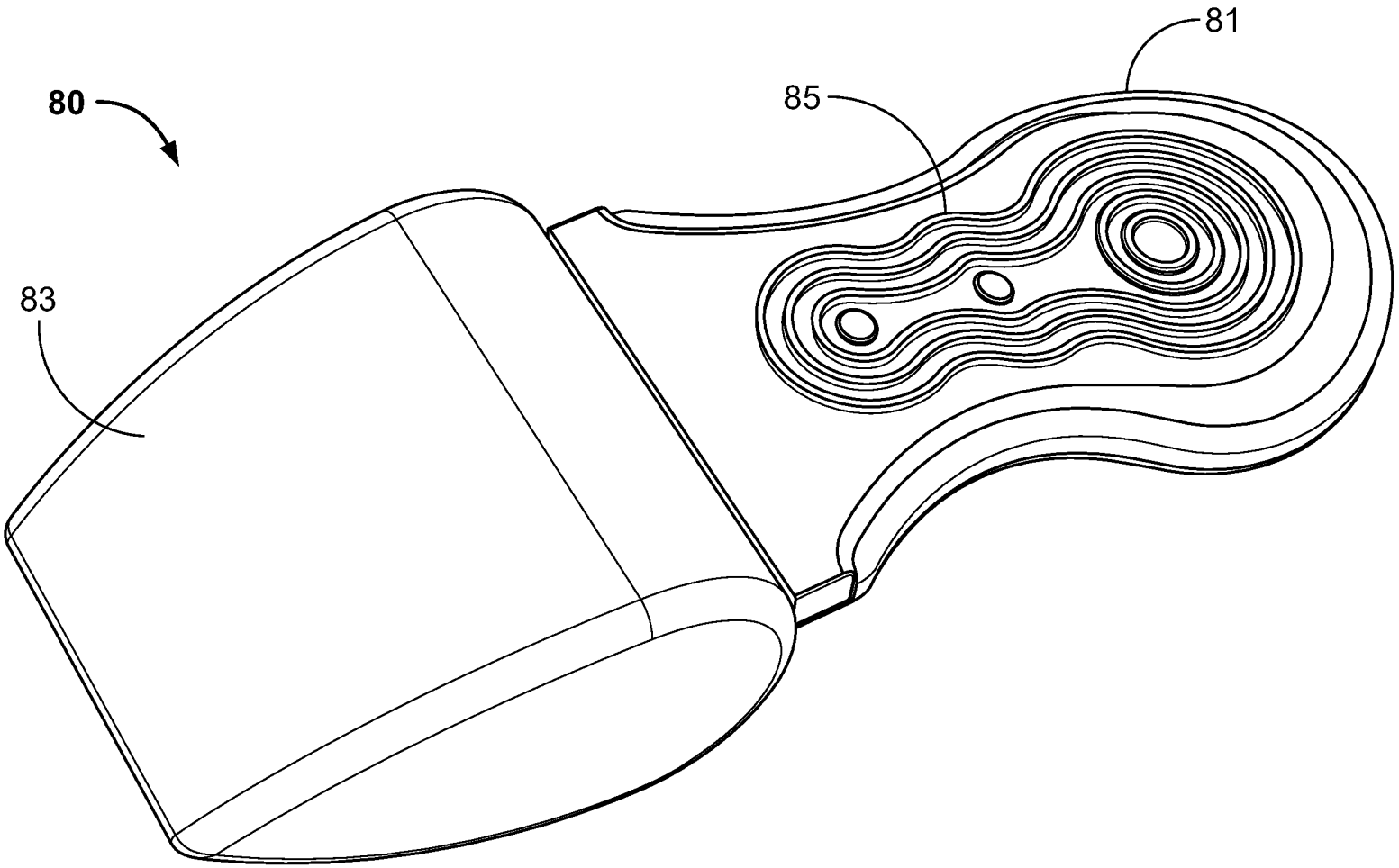
FIG. 8A shows a schematic view of the fluid discharger and applicator device with a flat handle according to another embodiment.
Figure 8B:
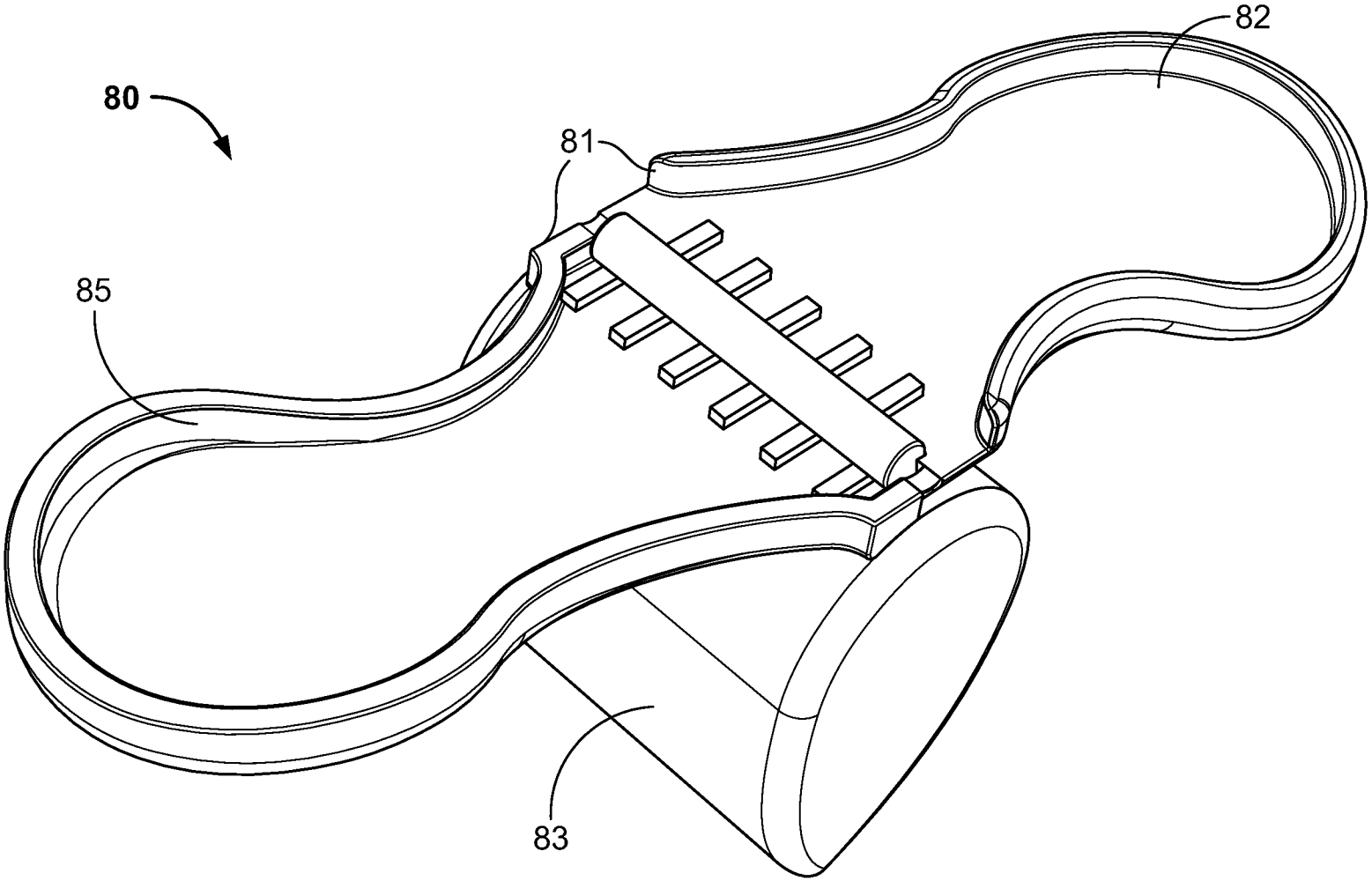
FIG. 8B shows a schematic view of the fluid discharger and applicator device with an openable and closeable type flat handle according to another embodiment.

FIG. 7 shows a schematic view of the fluid discharger and applicator device 70 with the tubular handle 31 with a groove structure 63 according to another embodiment. In one embodiment, the dispenser member 13 is fixed to the handle 31, where the surface of the handle 31 may have a rough or groove surface for firm holding by the user. The width of the dispenser member 13 ranges from about 20 mm to 40 mm, and the length of the handle 31 ranges from about 90 mm to 100 mm. FIG. 8A shows a schematic view of the fluid discharger and applicator device 80 with a flat handle 81 according to another embodiment. In one embodiment, the dispenser member 83 is fixed to the handle, where the surface of the flat handle 81 may have an etched glass designed surface 85 for firm holding by the user. In one embodiment, the dispenser member 83 is a wedge shaped structure. FIG. 8B shows a schematic view of the fluid discharger and applicator device 80 with an openable and closeable type flat handle 81 according to another embodiment. In an embodiment, the handle 81 is openable and closeable type. The handle may be layered, where one layer 82 of the handle is removably fastened to the other layer 85 to enable opening and closing of the layers in the handle 81. In an embodiment, the handle 81 is opened to refill with the fluids, and closed while applying the fluid on the user's skin. In one embodiment, the dispenser member 83 is a wedge shaped structure for cosmetic application.

Figure 9:
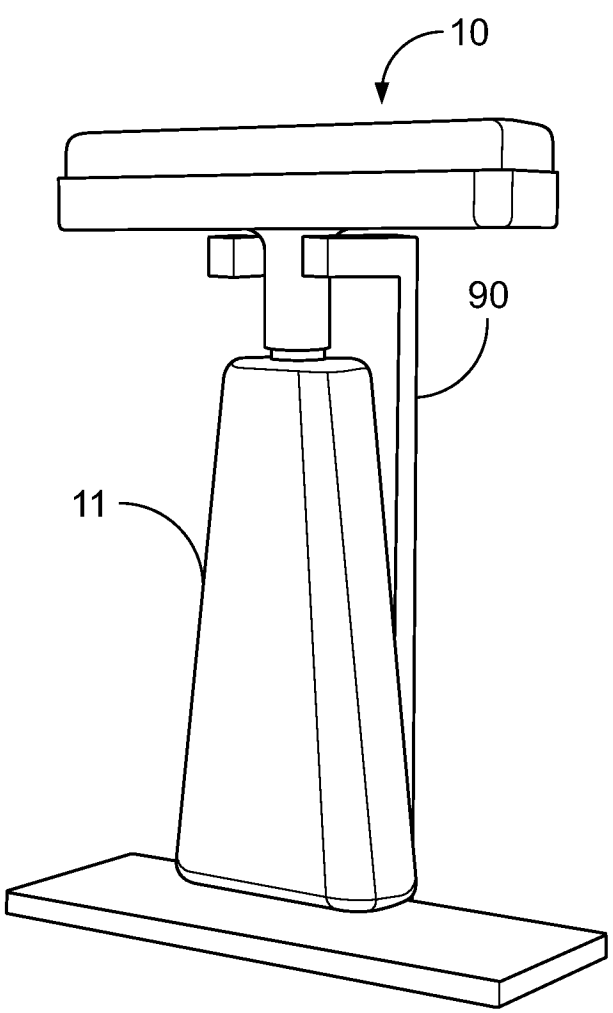
FIG. 9 shows a perspective view of a holder for hanging the fluid discharger and applicator device according to an embodiment.

Referring to FIG. 9 shows a perspective view of a holder 90 for hanging the fluid discharger and applicator device 10 according to an embodiment. In an embodiment, the fluid discharger and applicator device 10 further comprises a holder to hang the device 10 in up-right position. The holder 90 is designed to prevent the flow of fluid due to gravity during a standby mode. FIG. 9 shows a perspective view of a holder 90 for hanging the fluid discharger and applicator device 10 with the flask handle 11 for an example. The design of the holder 90 could be customized in accordance to the other designs of the handle according to an embodiment.

The advantage of the fluid discharger and applicator device is capable of uniformly distributing or applying the fluid for treating the user's skin, or any surface. The device further efficiently utilizes the amount of fluid such as liquid, pre-shave lotion, gel, moisturizer, skin cream or paste to the user's skin. The deviceallows the low-viscosity fluids, which is applied for daily use in a convenient and hygienic way. The fluid discharger and applicator device assist for providing longevity, rejuvenating and younger looking skin. Further, the device could be used for any type of skin-based applications such as anti-aging skin care, etc.

The foregoing descriptions comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Although specific terms may be employed herein, they are used only in generic and descriptive sense and not for purposes of limitation. Accordingly, the present invention is not limited to the specific embodiments illustrated herein.

What is claimed is:

1. An applicator device consisting of:

a hollow flat handle having a proximal end and a distal end, said flat handle configured to be fillable with fluid;

a rounded wedge-shaped dispenser member fixed to a said proximal end of the flat handle, said proximal end being straight and flat and affixed in a manner such that said flat handle and said wedge-shaped dispenser member are parallel and approximately equal in width;

wherein said dispenser member is configured to dispense said fluid from said flat handle onto a surface of a user's skin;

wherein said applicator device is configured to discharge and dispense said fluid via said flat handle and said dispenser member;

wherein a flat surface of said flat handle has an etched glass design for firm holding by a user;

wherein said flat handle is an openable and closeable type having a two-layered structure at said distal end of said handle wherein one layer of said flat handle is fastened to a second layer of said two-layered structure of said flat handle at said proximal end to enable opening and closing of said layers of said flat handle such that said handle is hollow and fillable and refillable with said fluid when open, and closed while applying said fluid, and wherein each of said layers of said two-layered structure of said handle are essentially equal in thickness;

wherein said flat handle has an essentially even thickness along its length and its width when closed;

wherein in a plan view, an approximate mid area of said flat handle has a curved neck area where lateral sides are concave relative to said proximal and distal ends of said flat handle with respect to a length of said flat handle;

wherein in a plan view, said distal end of said flat handle is rounded;

wherein in an area that the first layer and the second layer of said flat handle are fastened to each other at said proximal end of said flat handle proximate said dispenser member, there is hinge structure between the first layer and the second layer on an inside of said handle allowing such opening and closing of the first layer and the second layer of said flat handle;

wherein said hinge structure is a rectangular bar with a rounded top across a width of said proximal end of said flat handle, and wherein said hinge structure additionally has multiple squared-off rectangular bars smaller and shorter than said rectangular bar with the rounded top, said smaller bars protruding perpendicularly from both lateral sides of said bar with the rounded top.

2. The applicator device of claim 1, wherein said dispenser member consists of one of a sponge, a hydrophilic foam pad, and a rubber material.

3. The applicator device of claim 2 wherein said dispenser member consists of a sponge.

4. The applicator device of claim 3 wherein said dispenser member consists of a latex-free sponge.

5. The applicator device of claim 2 wherein said dispenser member consists of a hydrophilic foam pad.

6. The applicator device of claim 2 wherein said sponge consists of a rubber material.

7. The applicator device of claim 1 wherein said handle and dispenser member are reusable.

8. The applicator device of claim 1 wherein said handle and dispenser member are disposable.

* * * * *